US006227216B1

(12) United States Patent
Dweck

(10) Patent No.: US 6,227,216 B1
(45) Date of Patent: May 8, 2001

(54) UMBRELLA HAVING EARS

(75) Inventor: Isaac B. Dweck, New York, NY (US)

(73) Assignee: Berkshire Fashions Inc., New York, NY (US)

( * ) Notice: Subject to any disclaimer, the term of this patent is extended or adjusted under 35 U.S.C. 154(b) by 0 days.

(21) Appl. No.: 09/510,330

(22) Filed: Feb. 22, 2000

(51) Int. Cl.[7] ..... A45B 11/00; A45B 19/00; A45B 25/02

(52) U.S. Cl. ..... 135/15.1; 135/16; 135/33.2; D3/6

(58) Field of Search ..... 135/15.1, 16, 33.2; D3/6

(56) References Cited

U.S. PATENT DOCUMENTS

D. 324,943 * 3/1992 Wu ..... D3/6
D. 325,296 * 4/1992 Wu ..... D3/6
D. 441,652 * 6/1999 Tseng ..... D3/6
4,880,023 * 11/1989 Lin ..... 135/16 X
5,158,102 * 10/1992 Lemcke ..... 135/33.2 X
5,438,779 * 8/1995 Suarez ..... 135/16 X

* cited by examiner

*Primary Examiner*—Robert Canfield
(74) *Attorney, Agent, or Firm*—Ezra Sutton, Esq.

(57) ABSTRACT

A collapsible umbrella is provided having ear-like projections as part of its main canopy, and includes an umbrella frame with a central shaft having a handle at one end and a crown member at the other end. The umbrella frame also includes a plurality of radially extending ribs being connected to the crown member and a plurality of strut members being connected to the plurality of ribs. The umbrella frame further includes a first ear-like frame assembly and a second ear-like frame assembly, with the main canopy including first and second ear-like covers that extend over the first and second ear-like frame assemblies, respectively. Each of the first and second ear-like frame assemblies include a first frame wire member attached to a strut and a second frame wire member attached to a rib. Each of the first and second ear-like frame assemblies further includes a swivel guide sub-assembly for slidably receiving and guiding one of the first frame wire members in order to open or close the first and second ear-like frame assemblies on the umbrella frame. The swivel guide sub-assemblies are fixedly attached to a pair of diametrically opposed ribs.

3 Claims, 6 Drawing Sheets

FIG. 6A
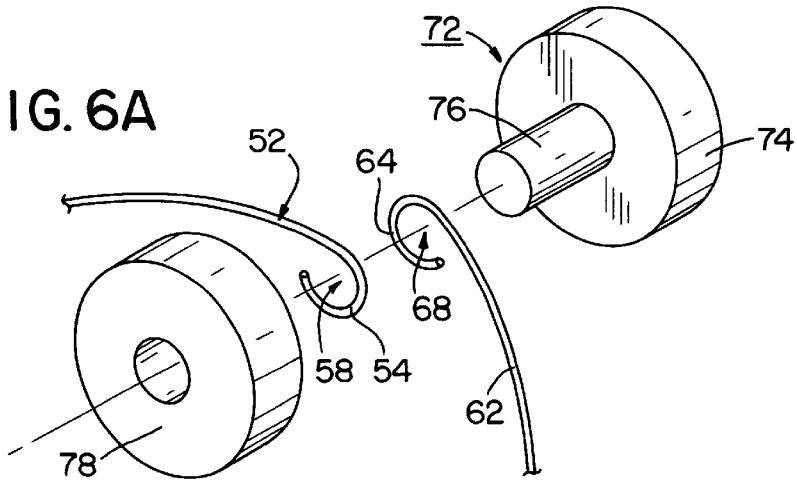
FIG. 6B
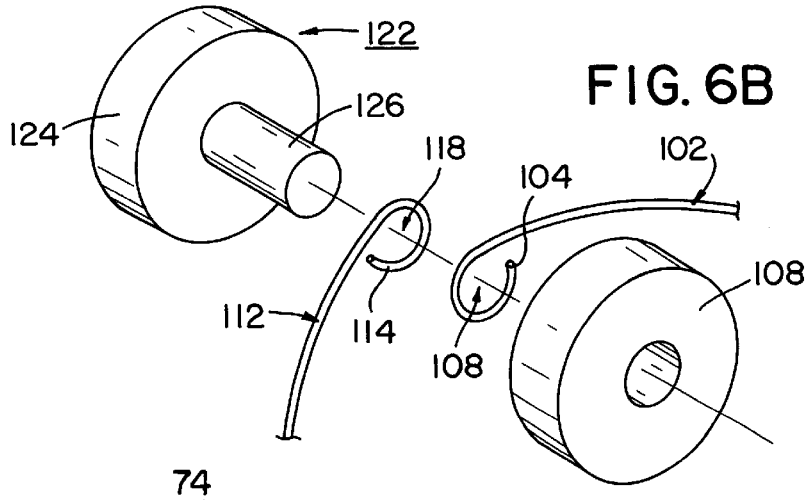
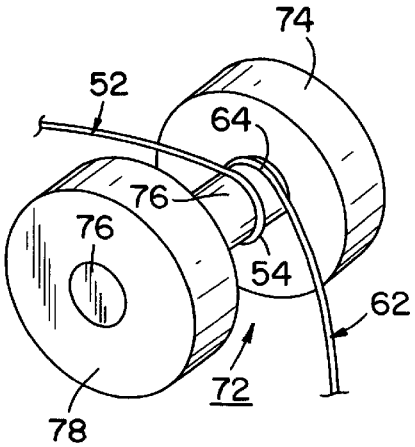
FIG. 7A
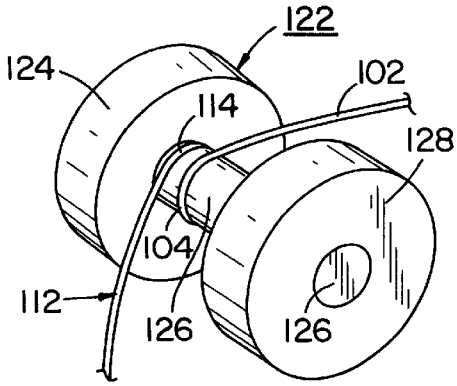
FIG. 7B

UMBRELLA HAVING EARS

FIELD OF THE INVENTION

The present invention relates to an umbrella having ear-like projections as part of its main canopy. More particularly, it relates to an umbrella frame having extendable ear-like frame assemblies that are completely collapsible when not in operational use.

BACKGROUND OF THE INVENTION

Novelty umbrellas having various shapes that extend from the main canopy are well known in the prior art. These umbrellas have shapes in the form of hats, baseball caps, football helmets, as well as, umbrellas having extending structures (defining ears) that outwardly project from the main canopy or dome of the umbrella shape.

There remains a need for a novelty umbrella having ear-like projections wherein the extendable ear-like frame structure is a simpler, less complex frame structure that operates more easily and smoothly when the umbrella is moved to its fully opened state, or to its fully closed or collapsed state.

DESCRIPTION OF THE PRIOR ART

Umbrellas with extending structures having various designs, configurations, structures and materials of construction have been disclosed in the prior art. For example, U.S. Pat. No. 4,880,023 to Lin discloses an umbrella which has a pair of animal ears extending from the dome-shaped canopy surface when in the open position. The animal ears are formed by a pair of loop-shaped frames. Each frame includes a brace, a pivotal joint connected to a stretcher member, a catcher member, a sleeve member and a connector coupling member being attached on the rib of the frame.

U.S. Pat. No. 5,158,102 to Lemcke discloses an umbrella having two collapsible protractable ear frame structures on a main canopy. Each ear structure includes a rib, struts, tubular sleeves that surrounds both struts, guide brackets, a swivel coupling, an attachment member and an ear canopy.

U.S. Design Pat. No. DES. 324,943 to Wu discloses an animal umbrella in the form of a cap having a rim, ear flaps and animal ears on the top of the canopy.

None of the prior art patents teach or disclose the design, configuration and structure for the extendable ear-like frame assemblies of the present invention of an umbrella having ears, wherein each frame assembly has a very simple and less complex ear-like projection structure than those shown in the prior art references, and operates more easily and smoothly.

Accordingly, it is an object of the present invention to provide a novelty umbrella having ear-like projections that extend outwardly from the umbrella's main canopy or dome of the curved umbrella shape.

Another object of the present invention is to provide a novelty umbrella having ears wherein each of the extendable ear-like frame assemblies have a simpler, less complex frame structure that defines each of the outwardly ear-like projections when the umbrella is in a fully opened state, or in a fully collapsed state.

Another object of the present invention is to provide an extendable ear-like frame structure having no movable component parts within the frame structure so it is easier to open and close each of the ear-like frame structures when the umbrella is opened and closed.

A further object of the present invention is to provide an umbrella having ears with improved extendable ear-like frame assemblies that can be mass produced in an automated and economical manner and is readily affordable by the user.

SUMMARY OF THE INVENTION

In accordance with the present invention, there is provided a collapsible umbrella is provided having ear-like projections as part of its main canopy, and includes an umbrella frame with a central shaft having a handle at one end and a crown member at the other end. The umbrella frame also includes a plurality of radially extending ribs being connected to the crown member and a plurality of strut members being connected to the plurality of ribs. The umbrella frame further includes a first ear-like frame assembly and a second ear-like frame assembly, with the main canopy including first and second ear-like covers that extend over the first and second ear-like frame assemblies, respectively. Each of the first and second ear-like frame assemblies include a first frame wire member attached to a strut and a second frame wire member attached to a rib. Each of the first and second ear-like frame assemblies further includes a swivel guide sub-assembly for slidably receiving and guiding one of the first frame wire members in order to open or close the first and second ear-like frame assemblies on the umbrella frame. The swivel guide sub-assemblies are fixedly attached to a pair of diametrically opposed ribs.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein:

FIG. 6A is an enlarged exploded perspective view of the umbrella having ears of the present invention of FIG. 3 showing the first frame attachment member and the first and second frame wire members;

FIG. 6B is an enlarged exploded perspective view of the umbrella having ears of the present invention of FIG. 3 showing the second frame attachment member and the first and second frame wire members;

Figure 3:
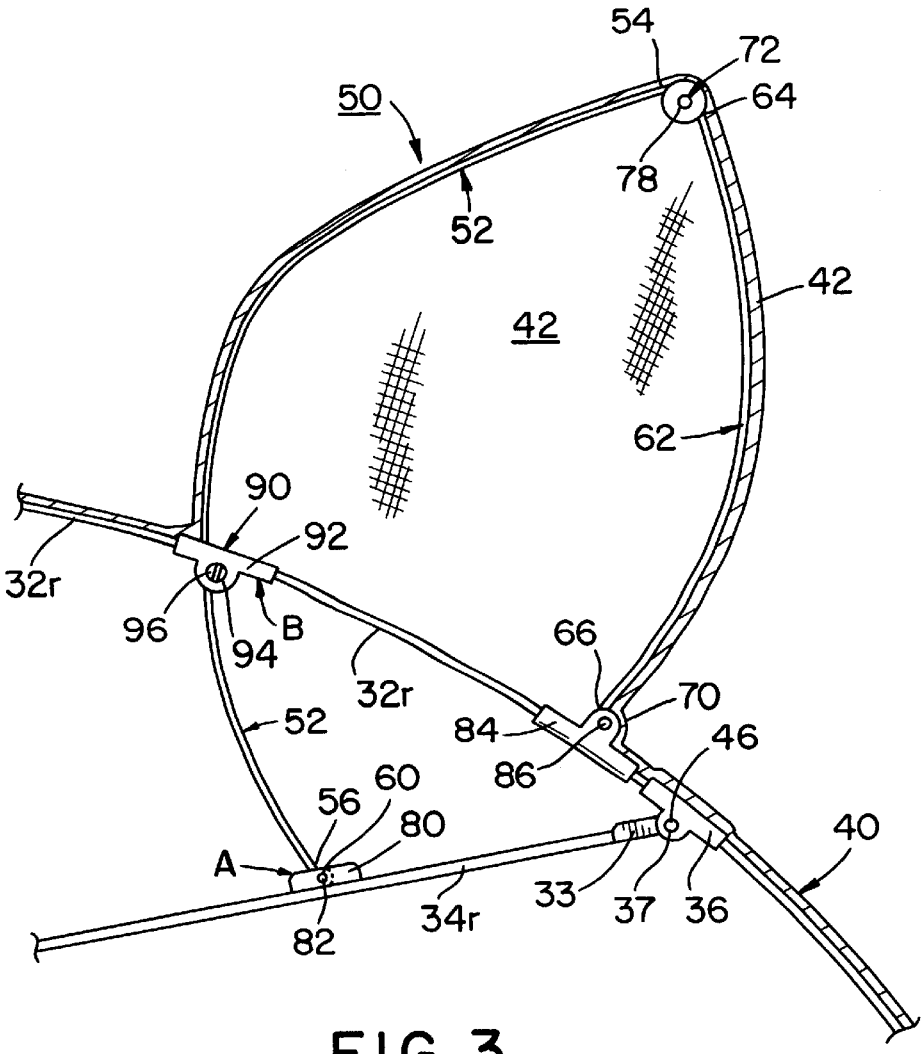
FIG. 3 is an enlarged front cutaway view of the umbrella having ears of the present invention of FIG. 2 showing the cone-shaped frame structure of the ear section.
Figure 8:
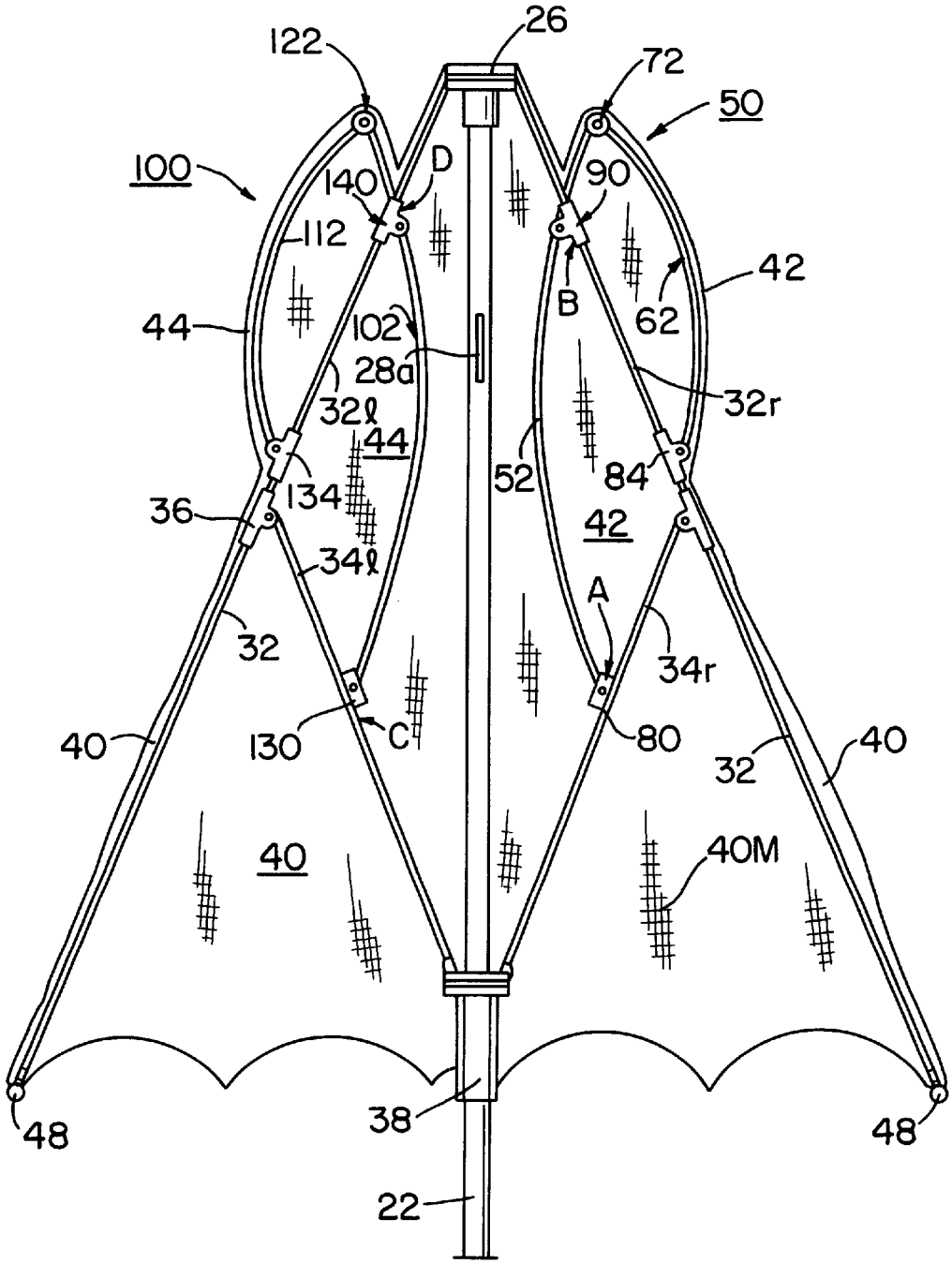

FIG. 7A is an enlarged partial perspective view of the umbrella having ears of the present invention of FIG. 3 showing the first frame attachment member connected to the first and second frame wire members;

FIG. 7B is an enlarged partial perspective view of the umbrella having ears of the present invention of FIG. 3 showing the second frame attachment member connected to the first and second frame wire members; and FIG. 8 is a front cross-sectional view of the umbrella having ears of the present invention showing the major component parts thereof, and in an unassembled and closed configuration being ready for operational use thereof.

DETAILED DESCRIPTION OF THE PREFERRED EMBODIMENT

The umbrella 10 having a pair of ear-like projections 50 and 100 and their component parts of the preferred embodiment of the present invention are represented in detail by FIGS. 1 through 8 of the patent drawings. The ear-like (projections) frame structures 50 and 100 having thereon ear-like fabric covers 42 and 44, respectively, are attached to the main canopy 40 of umbrella 10 and give the umbrella 10 the appearance of an animal (such as a dog, cat, pig, etc.), or a comic strip or TV character (such as "Batman™", "Pokemon™", etc.).

Figure 1:
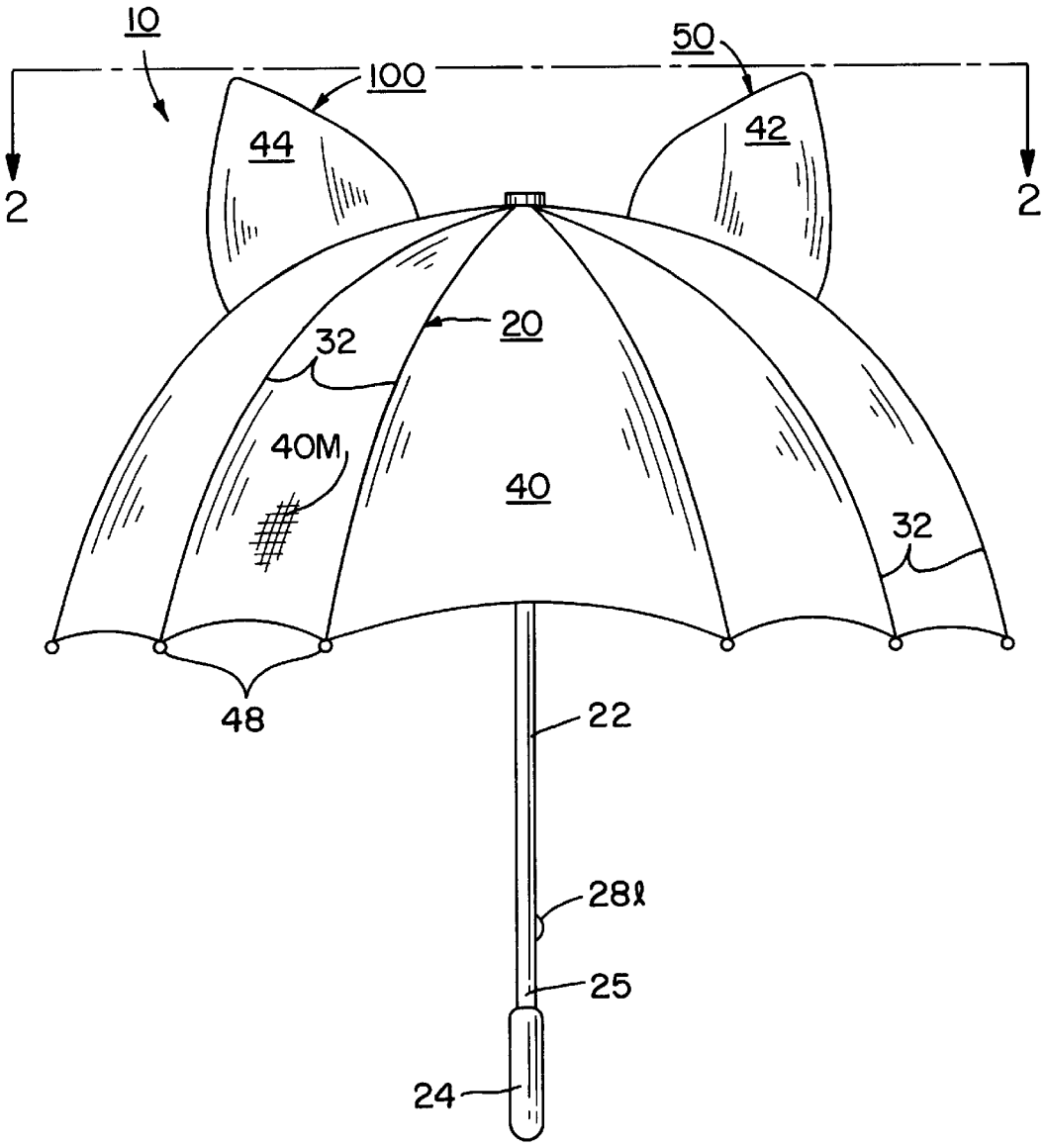
FIG. 1 is a front elevational view of the umbrella having ears of the preferred embodiment of the present invention showing the major component parts thereof, and in a fully assembled and opened configuration for operational use thereof.
Figure 2:
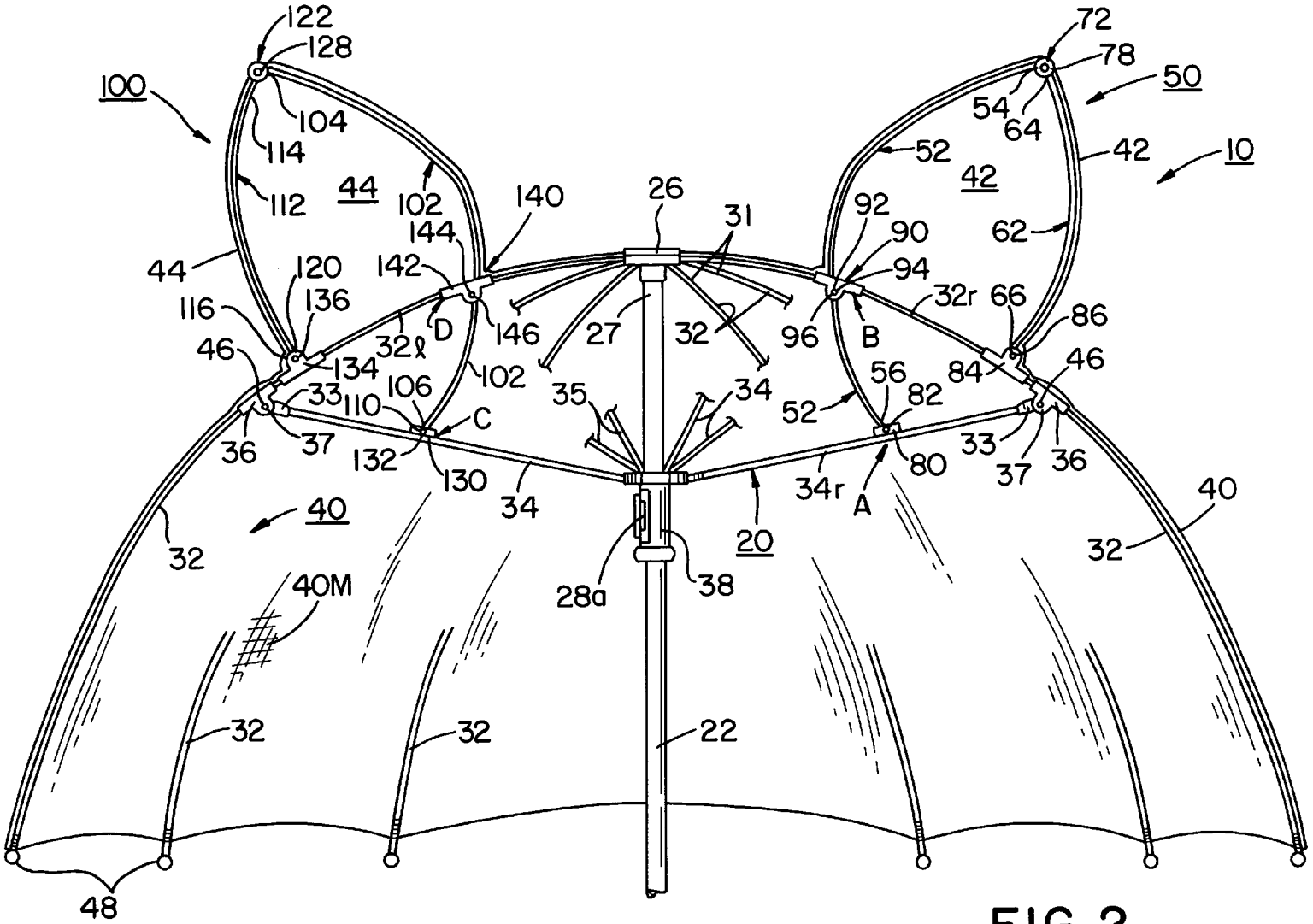
FIG. 2 is an enlarged cross-sectional view of the umbrella having ears of the present invention taken along lines 2—2 of FIG. 1 showing the cone-shaped frame structure assembly of both ears, the umbrella struts, the umbrella ribs, and the central umbrella shaft being in an opened configuration.
Figure 4:
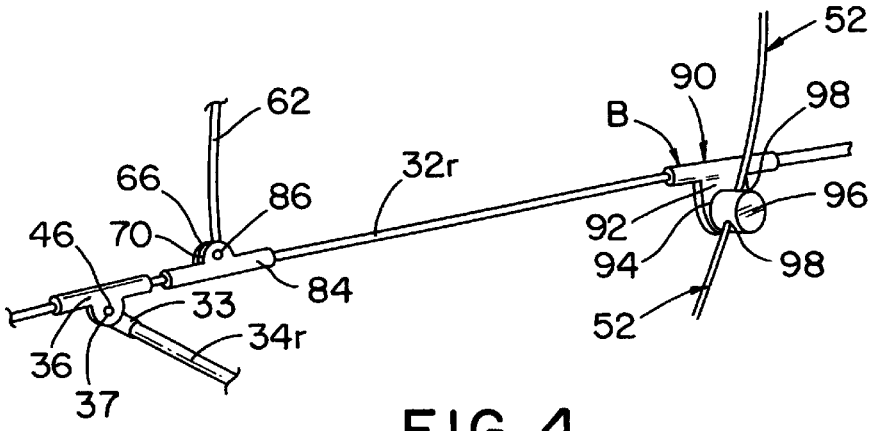
FIG. 4 is an enlarged partial rear perspective view of the umbrella having ears of the present invention of FIG. 3 showing the swivel guide assembly, the plurality of pivot attachment members, the first and second frame wire members, and the extending radial rib thereof.

The umbrella 10 includes an umbrella frame 20, as shown in FIGS. 1, 2 and 8 of the drawings, having a central shaft 22 with a handle or grip 24 at one end 25 and a crown member 26 at the other end 27. Central shaft 22 includes upper and lower catch members 28*u* and 28*l* for maintaining the umbrella frame 20 in an opened configuration (as shown in FIGS. 1 and 2), or in a closed configuration (as shown in FIG. 8). Umbrella frame 20 also includes a plurality of radially extending ribs 32 being connected to the crown member 26 at one end 31, and a plurality of strut members 34 being connected to the plurality of ribs 32 via pivot attachment members 36 at upper end 33 of each strut member 34. Additionally, the plurality of strut members 34, at their lower ends 35 are also connected to the central runner member 38 that slides on shaft 22. Each strut member 34 includes a hole opening 46 for connecting the strut end 33 of each strut member 34 to the pivot bar 37 of each pivot attachment member 36, which is mounted on each rib 32, as shown in FIGS. 3, 4 and 5 of the drawings.

Umbrella frame 20 further includes a main canopy 40 made of a preferably water-repellant cloth material that is stretched over the plurality of ribs 32. Ribs 32 are radially spaced about crown member 26 and pivotally extend outwardly from crown member 26 in a radial pattern, as shown in FIGS. 1 and 2 of the drawings. Ribs 32 pivot upwardly and downwardly on crown member 26 in order to expand and collapse the umbrella 10 when opening and closing the umbrella frame 20, as depicted in FIGS. 1, 2 and 8 of the drawings. Disposed on each tip of ribs 32 are canopy tie-off members 48 serving to receive the threads of the main canopy 40 in order to hold the main canopy material 40M being stretched over the plurality of ribs 32, as shown in FIGS. 1 and 2 of the drawings. In addition, the main canopy 40 includes two ear canopies or covers 42 and 44 that extend over each of the respective ear frame structures 50 and 100, as shown in FIG. 2 of the drawings.

Ear-like frame structure 50, as shown in FIGS. 2 and 3 of the drawings, includes a first frame wire member 52 having an upper looped-end 54 and a lower looped-end 56 with circular openings 58 and 60 formed therein, respectively, and a second frame wire member 62 having an upper looped-end 64 and a lower looped-end 66 with circular openings 68 and 70 formed therein, respectively. Each of the upper looped-ends 54 and 64 of the first and second frame wire members 52 and 62 are connected to a frame attachment member 72, as depicted in FIGS. 2 and 3 of the drawings. Frame attachment member 72 includes a cap member 74 having a shaft 76 extending therefrom and a cap holding member 78 mounted thereon. Shaft 76 is inserted and received within each of the upper circular openings 58 and 68 of the upper looped-ends 54 and 64 of wire members 52 and 62, respectively, so that cap holding member 78 securely holds the upper looped-ends 54 and 64 of wire members 52 and 62 firmly in place, as depicted in FIGS. 6A and 7A of the drawings.

Ear-like frame structure 50, as shown in FIGS. 2 and 3 of the drawings, further includes a pair of pivot attachment members 80 and 84. Pivot attachment member 80 includes a rivet or cylindrical bar 82 therein, and pivot attachment member 84 includes a rivet or cylindrical bar 86 therein. Each of the lower looped-ends 56 and 66 of the first and second frame wire members 52 and 62 are fixedly attached to each of the pivot attachment members 80 and 84, respectively. As shown in FIG. 3, each of the lower circular openings 60 and 70 of the lower looped-ends 56 and 66 are enclosed on each of the rivets 82 and 86 of pivot attachment members 80 and 84, respectively. Pivot attachment member 80 is fixedly attached to strut member 34*r* at point A of strut member 34*r*; and pivot attachment member 84 is fixedly attached to rib 32*r* and is adjacent to pivot attachment member 36, as depicted in FIGS. 2 and 3 of the drawings.

Figure 5A:
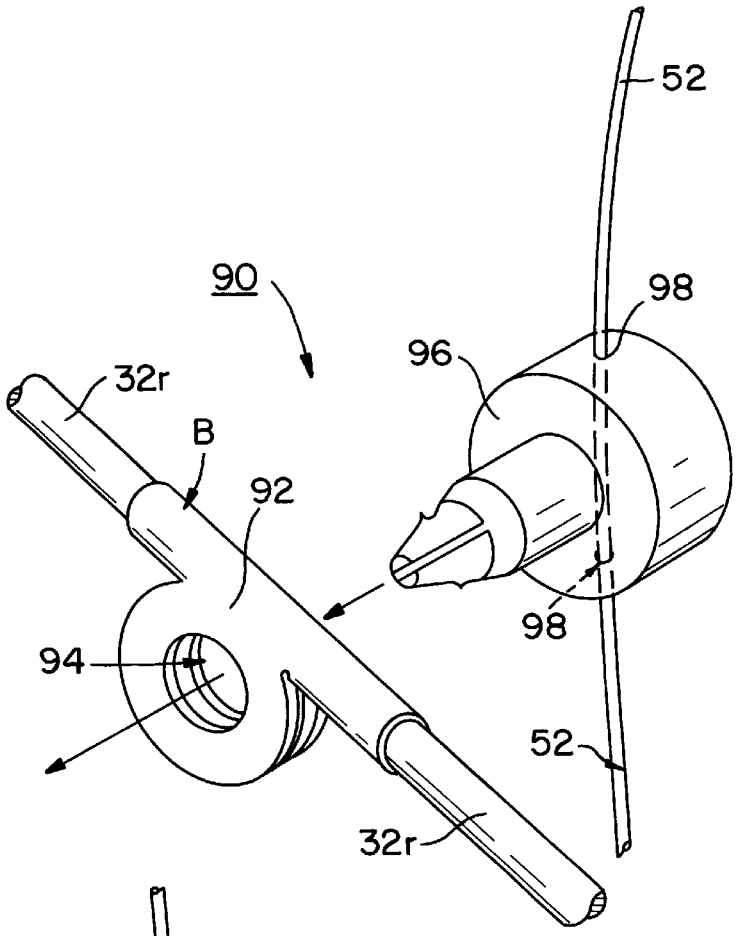
FIG. 5A is an enlarged exploded perspective view of the umbrella having ears of the present invention of FIG. 4 showing the component parts of the first swivel guide assembly.

Ear-like frame structure 50, as shown in FIGS. 2, 3 and 5A of the drawings, also includes a swivel guide sub-assembly 90 having a guide bracket 92 with a circular hole opening 94 therein for receiving a plug member 96 therethrough. Plug member 96 includes a wire opening 98 for receiving therethrough first frame wire member 52, as shown in FIGS. 3 and 5A of the drawings. Swivel guide sub-assembly 90 is fixedly attached to rib 32*r* at point B of rib 32*r*.

Ear-like frame structure 100, as shown in FIG. 2 of the drawings, includes a first frame wire member 102 having an upper looped-end 104 and a lower looped-end 106 with circular openings 108 and 110 formed therein, respectively, and a second frame wire member 112 having an upper looped-end 114 and a lower looped-end 116 with circular openings 118 and 120 formed therein, respectively. Each of the upper looped-ends 104 and 114 of the first and second frame wire members 102 and 112 are connected to a frame attachment member 122, as depicted in FIG. 2 of the drawings. Frame attachment member 122 includes a cap member 124 having a shaft 126 extending therefrom and a cap holding member 128 thereon. Shaft 126 is inserted and received within each of the upper circular openings 108 and 118 of the upper looped-ends 104 and 114 of wire members 102 and 112, respectively, so that cap holding member 128 securely holds the upper looped-ends 104 and 114 of wire members 102 and 112 firmly in place, as depicted in FIG. 2, 6B and 7B of the drawings.

Ear-like frame structure 100, as shown in FIG. 2 of the drawings, further includes a pair of pivot attachment members 130 and 134. Pivot attachment member 130 includes a rivet or cylindrical bar 132 therein, and pivot attachment member 134 includes a rivet or cylindrical bar 136 therein. Each of the lower looped-ends 106 and 116 of the first and second frame wire members 102 and 112 are fixedly attached to each of the pivot attachment members 130 and 134, respectively. As shown in FIG. 2, each of the lower circular openings 110 and 120 of the lower looped-ends 106 and are enclosed on each of the rivets 132 and 136 of pivot attachment members 130 and 134, respectively. Pivot attachment member 130 is fixedly attached to strut member 34*l* at point C of strut member 34*l*; and pivot attachment member 134 is fixedly attached to rib 32*l* and is adjacent to pivot attachment member 36, as depicted in FIG. 2 of the drawings.

Figure 5B:
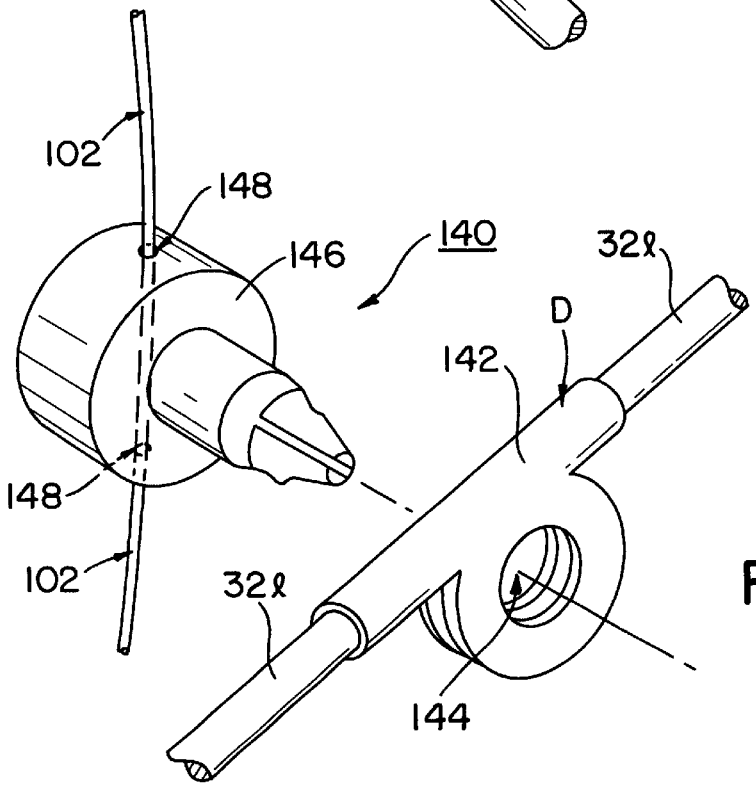
FIG. 5B is an enlarged exploded perspective view of the umbrella having ears of the present invention of FIG. 4 showing the component parts of the second swivel guide assembly.

Ear-like frame structure 100, as shown in FIG. 2 and 5B of the drawings, also includes a swivel guide sub-assembly 140 having a guide bracket 142 with a circular hole opening 144 therein for receiving a plug member 146 therethrough. Plug member 146 includes a wire opening 148 for receiving therethrough first frame wire member 102, as shown in FIG. 2 and 5B of the drawings. Swivel guide sub-assembly 140 is fixedly attached to rib 32*l* at point D of rib 32*l*.

Operation of the Present Invention

In operation, the umbrella 10 having ear-like projections 42 and 44 of the preferred embodiment of the present invention is readily put into operational use by opening umbrella 10 to an expanded and extended configuration, as depicted in FIGS. 1 and 2 of the drawings. The user simply pushes the central runner member 38 over the lower catch member 28*l* in an upward direction along central shaft 22 until the central runner member 38 is on the upper catch member 28*u*. This step extends all the ribs 32 radially from crown member 26, as shown in FIGS. 1 and 2 of the drawings. In performing this aforementioned step, each of the ear-like frame structures 50 and 100 also expand and extend into a fully opened configuration, as shown in FIGS. 1 to 3 of the drawings.

Each of the ear-like frame structures 50 and 100 expand and extend in the following manner. As the central runner member 38 moves upwardly along the central a shaft 22, strut members 34*r* and 34*l* move downwardly such that each of the lower looped-ends 56, 106, 66 and 116 of the first and second frame wire members 52, 102, 62 and 112, respectively, pivot around attachment members 80, 130, 84 and 134, respectively, in an arc motion, as shown in FIGS. 3 and 4 of the drawings. During this movement, each of the first frame wire members 52 and 102 slidably move within each of the wire openings 98 and 148 in swivel guide sub-assemblies 90 and 140, respectively, as shown in FIGS. 2 and 3 of the drawings, such that frame wire members 52, 62, 102 and 112 form a substantially equal sided triangle along each rib 32*r* and 34*l*, respectively, to form the expanded and extended ear-like frame assemblies 50 and 100, as depicted in FIGS. 1 and 2 of the drawings.

In closing or collapsing each of the ear-like assemblies 50 and 100, as shown in FIG. 8 of the drawings, the user would simply reverse the aforementioned steps.

Advantages of the Present Invention

Accordingly, an advantage of the present invention is that it provides for a novelty umbrella having ear-like projections that extend outwardly from the umbrella's main canopy or dome of the curved umbrella shape.

Another advantage of the present invention is that it provides for a novelty umbrella having ears wherein each for extendable ear-like frame assemblies have a simpler, less complex frame structure that defines each of the outwardly ear-like projections when the umbrella is in a fully opened state, or in a fully collapsed state.

Another advantage of the present invention is that it provides for an extendable ear-like frame having no movable component parts within the frame structure so it is easier to open and close each of the ear-like frame structures when the umbrella is opened and closed.

A further advantage of the present invention is that it provides for an umbrella having ears with improved extendable ear-like frame assemblies that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A collapsible umbrella having ear-like projections as part of its main canopy, comprising:

a) an umbrella frame including a central shaft having a handle at one end and a crown member at the other end; and a runner member slidably mounted on said central shaft;

b) said central shaft including upper and lower catch members for maintaining said umbrella frame in an opened configuration or in a collapsed configuration;

c) said umbrella frame including a plurality of radially extending ribs being connected to said crown member;

d) said umbrella frame including a plurality of strut members being connected to said plurality of ribs, wherein each of said strut members are rotatably connected at the upper end to a first pivot attachment member, each of said first pivot attachment members being fixedly attached to one of said plurality of ribs, wherein each of said strut members are fixedly connected at the lower end to said runner member;

e) said umbrella frame including a main canopy being stretched over said plurality of ribs when in the opened configuration;

f) said umbrella frame including a first ear-like frame assembly and a second ear-like frame assembly;

g) said main canopy including first and second ear-like covers that extend over said first and second ear-like frame assemblies, respectively;

h) each of said first and second ear-like frame assemblies including first and second frame wire members having upper looped-ends and lower looped-ends, each of said upper looped ends of said first and second wire members being connected to a frame attachment member;

i) said lower looped-ends of said first frame wire members being rotatably connected to second pivot attachment members; said second pivot attachment members being fixedly attached to a pair of said diametrically opposed struts;

j) said lower looped-ends of said second frame wire members being rotatably connected to third pivot attachment members; said third pivot attachment members being fixedly attached to a pair of said diametrically opposed ribs; and k) each of said first and second ear-like frame assemblies including a swivel guide sub-assembly for slidably receiving and guiding one of said first frame wire members in order to open or close said first and second ear-like frame assemblies on said umbrella frame; said swivel guide sub-assemblies being fixedly attached to said pair of diametrically opposed ribs.

2. A collapsible umbrella in accordance with claim 1, wherein each of said swivel guide sub-assemblies include a guide bracket having an opening therein, and a plug member for extending through said opening.

3. A collapsible umbrella in accordance with claim 2, wherein said plug members include a wire passageway extending therethrough for slidably receiving and guiding said first frame wire member as said umbrella is opened or closed.

* * * * *